US008298642B2

(12) United States Patent
Yuan et al.

(10) Patent No.: US 8,298,642 B2
(45) Date of Patent: Oct. 30, 2012

(54) FLOOR MAT ASSEMBLY

(75) Inventors: Ming Xiang Yuan, Shanghai (CN); Zhi Yong Dai, Shanghai (CN)

(73) Assignee: 3M Innovative Properties Company, St. Paul, MN (US)

( * ) Notice: Subject to any disclaimer, the term of this patent is extended or adjusted under 35 U.S.C. 154(b) by 780 days.

(21) Appl. No.: 12/280,571

(22) PCT Filed: Feb. 19, 2007

(86) PCT No.: PCT/US2007/004296
§ 371 (c)(1),
(2), (4) Date: Jul. 9, 2009

(87) PCT Pub. No.: WO2007/100533
PCT Pub. Date: Sep. 7, 2007

(65) Prior Publication Data

US 2009/0304985 A1 Dec. 10, 2009

(30) Foreign Application Priority Data

Feb. 28, 2006 (CN) ..... 2006 1 0051553

(51) Int. Cl.
*B32B 3/10* (2006.01)
*B32B 3/02* (2006.01)

(52) U.S. Cl. ..... 428/45; 428/48

(58) Field of Classification Search ..... 428/45, 428/44, 48; 52/177, 180; 404/35, 36
See application file for complete search history.

(56) References Cited

U.S. PATENT DOCUMENTS

| | | | | |
|---|---|---|---|---|
| 3,868,798 | A * | 3/1975 | Spica | 52/100 |
| 4,373,306 | A | 2/1983 | Rech | |
| 4,468,910 | A * | 9/1984 | Morrison | 52/591.2 |
| 4,497,858 | A * | 2/1985 | Dupont et al. | 428/44 |
| 4,654,245 | A | 3/1987 | Balzer et al. | |
| 5,386,670 | A | 2/1995 | Takeda et al. | |
| 5,628,160 | A | 5/1997 | Küng | |
| 2005/0252109 | A1 * | 11/2005 | Fuccella et al. | 52/177 |

FOREIGN PATENT DOCUMENTS

| | | |
|---|---|---|
| EM | 000050638.0001 | 10/2003 |
| EM | 000050638.0002 | 10/2003 |
| EM | 000050638.0003 | 10/2003 |
| EM | 000050638.0004 | 10/2003 |
| EM | 000050638.0005 | 10/2003 |
| EM | 000050638.0006 | 10/2003 |
| EM | 000050638.0007 | 10/2003 |
| EP | 0 506 499 | 9/1992 |
| KR | 10-0200269 | 10/1992 |
| KR | 20-0130753 | 5/1997 |
| WO | WO 92/20885 | 11/1992 |

* cited by examiner

*Primary Examiner* — Alexander Thomas
(74) *Attorney, Agent, or Firm* — David B. Patchett

(57) ABSTRACT

A sectional floor mat system of floor mats and edging sections or pieces that are removably engaged with the floor mats. The floor mat system includes at least one mat and sufficient edging to border at least one of the side edges of the at least one mat. In many embodiments, there is sufficient edging to border all side edges of the at least one mat, when multiple mats, if present, and connected together. The edging pieces of the invention, and other variations thereof, when combined with mats, provide a floor covering system that is easy for the user to set-up, disassemble as needed, and inhibit tripping on the edges of mats.

19 Claims, 4 Drawing Sheets

FLOOR MAT ASSEMBLY

CROSS REFERENCE TO RELATED APPLICATIONS

This application is a national stage filing under 35 U.S.C. 371 of PCT/US2007/004296, filed Feb. 19, 2007, which claims priority to China Application No. 10051553.5, filed Feb. 28, 2006, the disclosure of which is incorporated by reference in its/their entirety herein.

FIELD OF THE DISCLOSURE

The present disclosure is directed to sectional floor matting, in particular, to edging for sectional floor matting.

BACKGROUND OF THE DISCLOSURE

Carpets and rugs have long been used to cover the ground, floor, and other surfaces. Floor coverings are not only functional in that they protect the floor, collect and retain dirt, mud and water, but they are also aesthetical. Depending on the material, the floor covering may also provide a cushion, softening the surface and thus easing stress on the user.

Floor coverings have evolved to include modular systems that can be designed on the spot for the specific application. For example, twelve 1 foot by 1 foot (about 30.5 cm by 30.5 cm) interlocking mats can be combined to form a 12 square foot mat (about 1.1 $m^2$), either 2 foot by 6 foot (about 61 cm by 183 cm) or, 3 foot by 4 foot (about 91.5 cm by 122 cm). Such interlocking sectional matting is a popular system for customizing floor mats. Additionally, with such sectional matting systems, it is possible to replace only the worn or damaged mat sections when needed, rather than having to replace the entire mat.

3M Company has a sectional matting product line that is well recognized. Various NOMAD™ floor mats are available, with a variety of physical properties, such as thickness, mat density, material, mat section size, etc. The mats are configured to interlock, providing various shapes and sizes of matting. In one installation design, the mats are placed into a recessed well in the floor, so that the top surface of the mats is approximately level with the ground. In another installation design, where there is no recessed well, tapered or ramped edging is placed around the perimeter of the mat, to reduce the chance a user may trip on the edge of the mat. The edging is generally glued to the mat, to inhibit the mat and edging from becoming separated. Typically, when either the mat or the edging is worn or damaged, both the edging and the mat section are replaced.

The present invention provides a floor mat system that increases the benefits associated with using sectional matting.

SUMMARY OF THE DISCLOSURE

An aspect of the present disclosure is directed to a sectional floor mat system to allows varying sizes of floor mats to be created from smaller floor mats. Edging sections or pieces are removably engaged with the floor mats to inhibit tripping on the edge of the mat.

An exemplary embodiment of the floor mat system of the present disclosure is a sectional system that includes at least one mat and sufficient edging to border at least one of the side edges of the at least one mat. In many embodiments, there is sufficient edging to border all side edges of the at least one mat, when multiple mats, if present, and connected together.

In one particular aspect, the disclosure is directed to a perimeter section for releasably attaching to a mat, the perimeter section having a transition portion with a variable thickness, and an engagement portion, the engagement portion comprising an engagement element configured to releasably engage with the mat.

The disclosure is also directed to a mat having main section having at least one edge, and a perimeter section removably engaged adjacent to the at least one edge, the perimeter section having a variable thickness, wherein the thickness of the perimeter section is substantially the same as the mat thickness adjacent the at least one edge, and the perimeter section has a portion having a thickness that decreases as the perimeter section extends outwardly from the edge of the main section.

A mat system is within this disclosure, the mat system being a combination of at least one mat and at least one perimeter or edging section that releasably attaches to the mat. In one more specific embodiment, the mat system has at least one floor mat having a side edge, the side edge having a first engagement element, and an edging section having a transition portion with a variable thickness and an engagement portion, the engagement portion comprising a second engagement element, the second engagement element configured to releasably engage with the first engagement element. The floor mat and the perimeter section may have the same or similar surface pattern. The mat system may have multiple mats, which preferably are interlockable. The mat system may also include at least one corner piece.

The present disclosure is also directed to a combination of a mat having a side edge, the side edge having a first engagement element, and an edging section configured to abut the side edge of the floor mat, the edging section having a transition portion with a variable thickness, and an engagement portion, the engagement portion comprising a second engagement element configured to releasably engage with the first engagement element. Added to the combination could be a corner piece configured to abut an end edge of the edging piece, the corner piece having a transition portion and an engagement portion.

A kit is also within the disclosure, the kit comprising a mat section having a thickness and at least one edge, and a perimeter section capable of being removably engaged adjacent to the at least one edge, the perimeter section having a variable thickness, wherein the thickness of the perimeter section is substantially the same as the mat thickness adjacent the at least one edge, and the perimeter section thickness decreases as the perimeter section extends outwardly from the edge of the mat section.

A modular mat can be assembled by providing a mat section having a thickness and at least one edge, and removably attaching a perimeter section adjacent to the at least one edge, the perimeter section having a variable thickness, wherein the thickness of the perimeter section is substantially the same as the mat thickness adjacent the at least one edge, and the perimeter section thickness decreases as the perimeter section extends outwardly from the edge of the main section.

These and other embodiments and aspects are within the scope of this disclosure.

DETAILED DESCRIPTION

Figure 1:
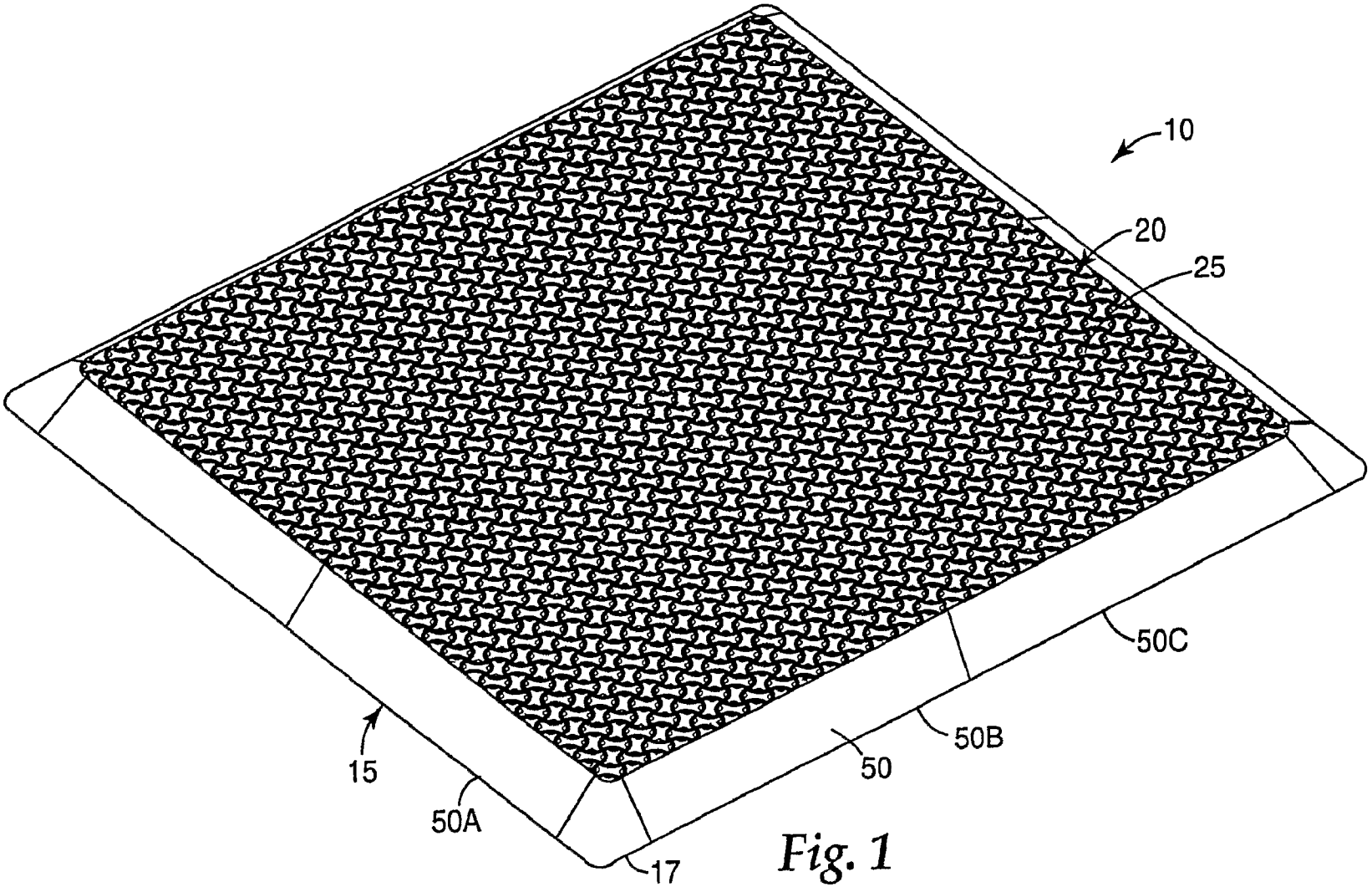
FIG. 1 is a perspective view of a floor mat system assembled from multiple floor mats and edging sections.

Referring to the figures, various embodiments of floor mat edging according to the present invention are provided. In FIG. 1, a floor mat system, composed of a plurality of floor mats and a plurality of edging, is illustrated generally at 10. System 10 is composed of a plurality of floor mats 20 (specifically, four floor mats 20) and an edging system 15 that circumscribes the plurality of mats 20. In this embodiment, edging system 15 has a plurality of side edging sections 50 (three of which are individually illustrated as 50A, 50B, 50C), which will be described in detail below.

Figure 2:
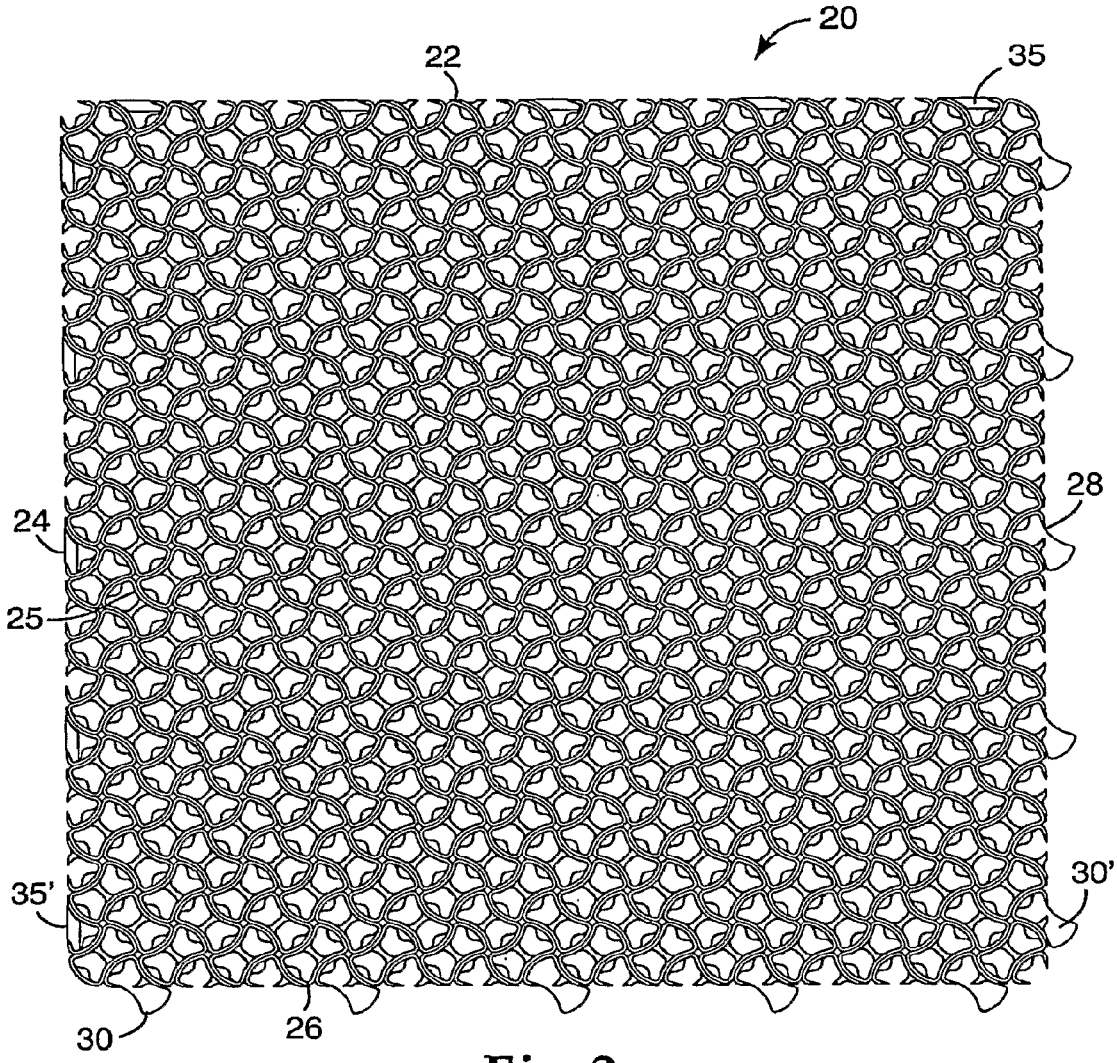
FIG. 2 is a top plan view of a floor mat suitable for use with edging sections of the present invention.

FIG. 2 illustrates an enlargement of mat 20. Mat 20 has a first side edge 22, a second side edge 24, a third side edge 26 and a fourth side edge 28. Mat 20 has a bottom surface that contacts the ground, floor, or other surface on which mat 20 is placed, and top surface opposite the bottom surface for walking thereon. Mat 20 includes a pattern 25 on its top surface; pattern 25 may extend through mat 20 to the bottom surface. Pattern 25 is configured to facilitate retention of water, mud, dirt, and other material that should be retained rather than trekked around. In this particular embodiment, pattern 25 is composed of passages or voids that extend through mat 20 from the top surface to the bottom surface. One example of such mats 20 is shown in registered Community design No. 000050638, Applicant of which is 3M Innovative Properties Company.

Mat 20 includes a plurality of engagement elements to facilitate connection of multiple mats 20 together. See FIG. 1, where four mats 20 are connected together. Side edges 22, 24, 26, 28 of mat 20 include first and second engagement elements, which are adapted to releasably engage. The first and second engagement elements might be referred to as "books" and "receptacles", "male" and "female", or other engagement elements. Mat 20 includes hooking elements 30, 30' that extend out from side edges 26 and 28, and receivers 35, 35' in side edges 22 and 24. Hooking elements 30, 30' engage with receivers 35, 35'. In particular, side edge 22 includes receivers 35, side edge 24 includes receivers 35', side edge 26 includes hooking elements 30 and side edge 28 includes hooking elements 30'. In alternate configurations, any or all side edges of the mat may include both hooking elements and receivers; for example, one side may include three hooking elements and two receivers, and another side may include two hooking elements and three receivers.

Hooking elements 30', in relation to side 28, are orthogonal to hooking elements edge 30, in relation to side edge 26. That is, when viewing the length of side edge 28, hooking elements 30' extend from right to left as they extend out from side edge 28, whereas hooking elements 30 extend from left to right as they extend out from side edge 26. In a similar manner, receivers 35', in relation to side edge 24, are orthogonal to receivers 35, in relation to side edge 22. That is, when viewing the length of side edge 24, receivers 35' extend from right to left as they approach side edge 24 from the center of mat 20, whereas receivers 35 extend from left to right as they approach side edge 22 from the center of mat 20. Hooking elements 30, 30' and receivers 35, 35' are thus configured so that appropriately configured receivers 35, 35' are available to engage with hooking elements 30, 30'.

The present invention provides edging system 15 that at least partially circumscribes mat(s) 20. Individual edging sections 50 correspond with the engagement elements of mat 20 to releasably retain edging sections 50 to mat 20. Edging sections 50 include a transition portion 60, which has a beveled or angled surface that facilitates the progression from the ground, floor or other surface on which edging section 50 is placed and the top of mat 20; transition portion 60 is a ramp from a surface below the top of mat 20 (e.g., the floor) to the top of mat 20. Transition portion 60 is that portion of edging sections 50 that circumscribes mat 20 and is visible in FIG. 1. Transition portion 60 has first end 62 and second end 64 opposite first end 62. The length of edging section 50 is the distance between end 62 and end 64. Transition portion 60 also has an outer edge 66. Edging section 50 also includes an attachment portion 52, which preferably includes a surface having pattern 25. Attachment portion 52 includes appropriate engagement elements to non-adhesively engage mat 20.

Figure 3:
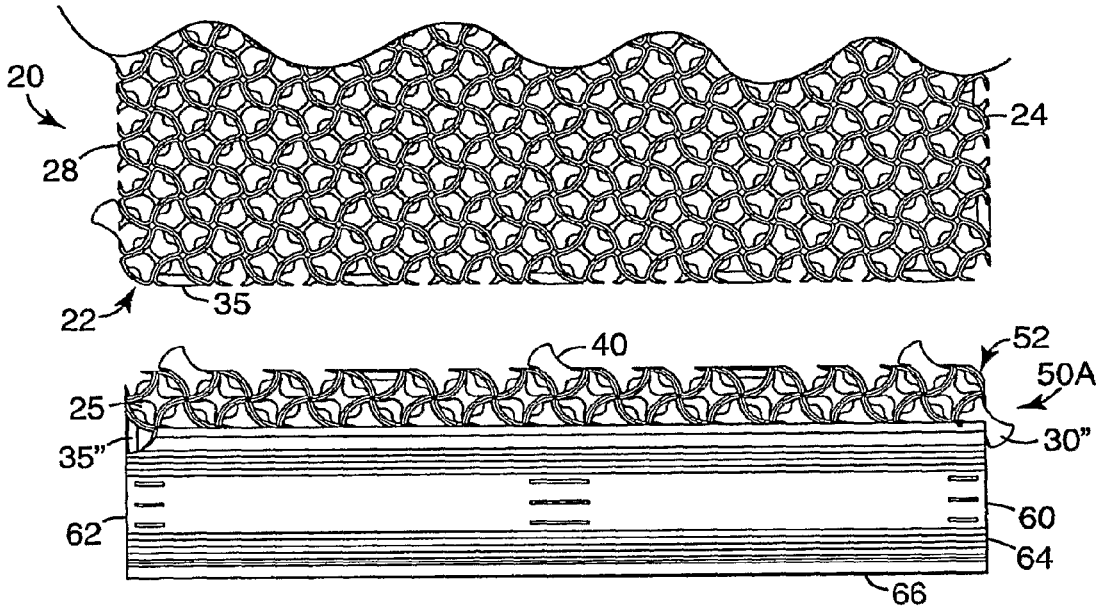
FIG. 3 is a top view of a first embodiment of an edging section configured for engagement with a first side of the floor mat.
Figure 6:
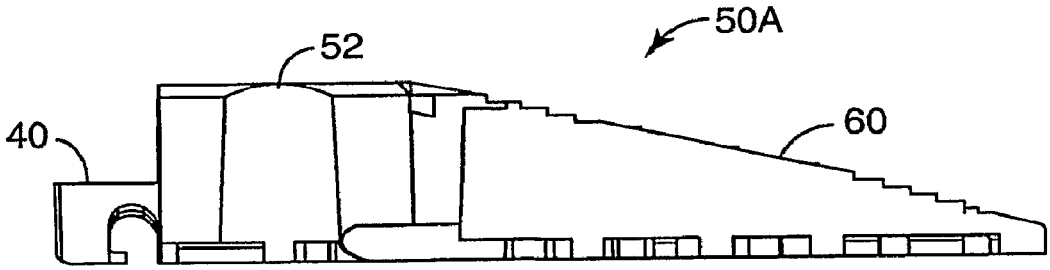
FIG. 6 is a side plan view of the edging section of FIG. 3.

Referring to FIG. 3 in particular, a first embodiment of an edging section 50 is illustrated as edging section 50A. Edging section 50A is configured to engage with side edge 22 of mat 20. Side edge 22 includes receivers 35. Attachment portion 52 of edging section 50A has at least one, and preferably an equal number of hooking elements 40 as receivers 35 on side edge 22, to engage edging section 50A to side edge 22. In this particular embodiment side edge 22 has three receivers 35 and edging section 50A includes three hooking elements 40 configured to releasably engage with receivers 35; it is understood that more or less receivers 35 and hooking elements 40 could be present. Edging section 50A is also shown in FIG. 6.

Figure 4:
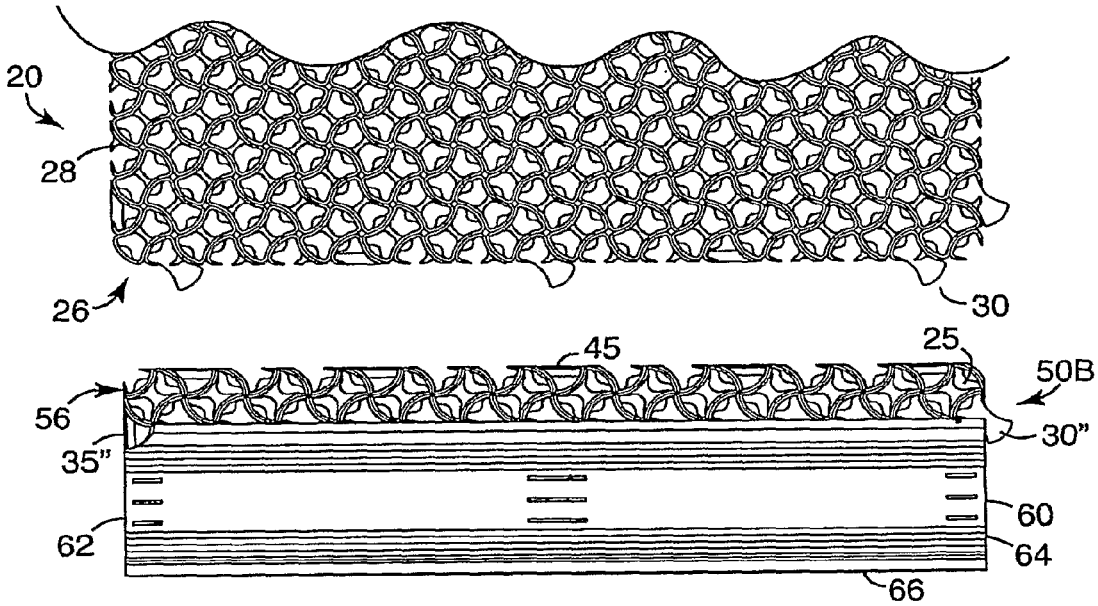
FIG. 4 is a top view of a second embodiment of an edging section configured for engagement with a second side of the floor mat.

Now referring to FIG. 4, a second embodiment of an edging section 50 is illustrated as edging section SOB. Edging section SOB is configured to engage with side edge 26 of mat 20. Side edge 26 includes hooking elements 30. Attachment portion 56 of edging section 50B has at least one, and preferably an equal number of receivers 45 as equal to the number of hooking elements 30 on side edge 26, to engage edging section 50B to side edge 26. In this particular embodiment side edge 26 has three hooking elements 30 and edging section 50B includes three receivers 45 configured to releasably engage with hooking elements 30; it is understood that more or less receivers 45 and hooking elements 30 could be present.

Although not illustrated, two additional embodiments of edging section 50 would be used for engagement with side edge 24 and side edge 28 of mat 20. An edging section similar to edging section 50A, but with hooking elements turned orthogonal to hooking elements 40, would engage side edge 24, which has receivers 35'. Similarly, an edging section similar to edging section SOB, but with receivers turned orthogonal to receivers 45, would engage side edge 28, which has hooking elements 30'.

Edging sections 50A, 50B each have three engagement elements for engaging with the appropriate side edge of mat 20. There should be at least one, preferably at least two, and more preferably the number of engagement elements between edging section 50 and mat 20 is the same. Generally, the number of hooking elements 30, 30' mat 20 should not exceed the number of receivers 45 on edging section 50, nor should the number of hooking elements 40 on edging section 50 exceed the number of receivers 35, 35' on mat 20.

Edging sections 50, such as edging sections 50A, SOB, include engagement elements at ends 62, 64 to connect adjacent edging sections 50 together. For example, edging section 50A, at side edge 64, is configured to releasably attached to edging section 50B at side edge 62. For both edging sections 50A, SOB, first side 62 includes a receiver 35" and second side 64 includes a hooking element 30". More than one receiver 35" or hooking element 30" may be present in sides 62, 64.

Edging sections 50 form a portion of perimeter 15 around mat(s) 20. Edging sections 50, however, are configured for placement against side edges 22, 24, 26, 28 of mats 20. Each of edging sections 50, such as edging sections 50A, 50B, has a length from side edge 62 to side edge 64 that is generally the same as the width of mat 20, particularly, the length of the side edge to which that edging section engages. Edging sections 50 generally do not extend passed the width of mat 20. To provide perimeter 15 around mat(s) 20, corner pieces 17 are provided.

Figure 5:
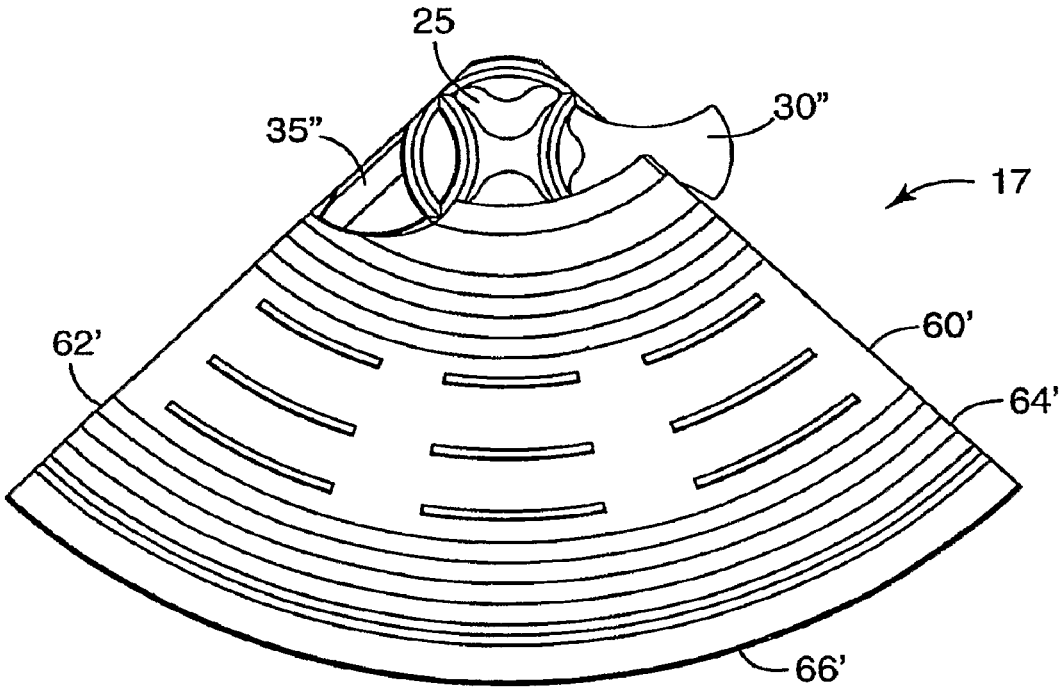
FIG. 5 is a top view of a corner edging section configured for engagement with the floor mat.

Corner pieces 17 are a 90 degree, angle piece that fill in the perimeter around mat(s) 20 where edging sections 50 do not extend. Corner piece 17 is illustrated in FIG. 5.

Corner pieces 17 include a transition portion 60', similar to transition portion 60 of edging sections 50, which has a beveled or angled surface that facilitates the progression from the ground or floor on which corner pieces 17 is placed and the top of mat 20. Transition portion 60' has first end 62' and second end 64' opposite first end 62'. First end 62' is configured for abutment and attachment to second end 64 of edging sections 50, and second end 64; is configured for abutment and attachment to first end 62 of edging sections 50. Transition portion 60' also has an outer edge 66'. Corner pieces 17 preferably include a surface having pattern 25.

Corner pieces 17 include engagement elements thereon to connect corner pieces 17 to adjacent edging sections 50. Corner piece 17 includes appropriate engagement elements to engage mat 20. In this embodiment, proximate first end 62' is a receiver 3511 for releasable engagement with hooking element 30" on second end 64 of edging section 50, and proximate second end 64' is a hooking element 30" for releasable engagement with receiver 35" on first end 62 of edging section 50. More than one receiver 35" or hooking element 30" may be present on ends 62', 64'.

In use, edging sections 50 and corner pieces 17 are combined with mat 20, often a plurality of mats 20, to form a mat system. Together, outer edge 66 of edging sections 50 and outer edge 66' of corner pieces 17 form the outermost edge of perimeter 15, and transition portions 60, 60' preferably provide a ramped or sloped surface up from perimeter 15 to the top surface of mat(s) 20. Although transition portions 60, 60' have been illustrated as a ramped portion with a beveled edge or chamfer, transition portions 60, 60' could be curved or arced, such as a fillet, stepped, or ribbed. In FIG. 6, transition portion 60 includes a textured surface to increase slip resistance on the surface.

The mat system includes mat(s) 20, edging sections 50, and corner pieces 17. An appropriate number of edging sections 50 and four corners 17 form a rectangular perimeter 15 around mat(s) 20. For example, in FIG. 1, four mats 20 are illustrated surrounded by 8 edging sections 50 and four corners 17. If only one mat 20 were used, four edging sections 50 and four corners 17 would be used to encircle mat 20. In some installations, it may be desired to not have all the sides of mat(s) 20 edged; for example, mat 20 may be positioned to abut a wall, so that only three side edges would have edging sections 50 thereon. In such an embodiment, probably only two corner pieces 17 would be used.

A mat system, to encircle mat 20 of FIG. 2 having the hooking elements 30, 30' and receivers 35, 35', would include five different pieces; edging section 50A, edging section SOB, an edging section similar but orthogonal to piece 50A, an edging section similar but orthogonal to piece 50B, and four corners 17. If the engagement elements (e.g., hooking elements 30, 30' and receivers 35, 35') on a mat differ, so will the edging sections. For example, a mat system could have three different pieces: edging section 50A, edging section SOB, and four corners 17.

Although edging sections 50 have been illustrated as having the same length as the width of mat 20 to which they are attached, edging sections 50 could be longer, to engage more than one mat, or shorter, to engage less than one mat. For example, one edging section could be configured to engage three adjacent mats, for example, to extend the entire side edge of a mat system.

Edging section 50, corner piece 17, and other embodiments, can be made from any suitable material, including polymers (plastics), metal, wood, composites, clay, and the like. The most preferred, however, are polymeric materials. It may be desirable to have two or more materials present in edging section 50 or corner piece 17.

Edging section 50 or corner piece 17 can be a unitary piece or assembled from multiple pieces. A polymeric unitary piece can readily be injection molded using conventional techniques. Other molding and extrusions techniques could also be used.

It is to be understood, however, that even though numerous specific characteristics and elements of the mat system and edging sections of the present disclosure have been described, other embodiments are within the scope of the invention. For example, edging sections 50A, 50B described above have a single row of pattern 25. Alternate embodiments could have more than one row of pattern, or, have an amount of pattern 25 that is equivalent to mat 20. Such an embodiment could be described as mat 20 having transition portion 60 permanently attached thereto.

Also for example, the description above has been made with square mats 20. It should be understood that other shaped mats would also be in accordance with the present invention. Examples of shapes include rectangles, parallelograms, rhombus, hexagons, triangles, and other polygons, including irregular polygons such as bowties, L-shaped, or U-shaped. The mats could have curved surfaces. Additionally or alternatively, the resulting mat system could have any shape, such a square, rectangle, parallelogram, rhombus, hexagon, triangle, and other polygons including irregular polygons. Circular or arced shapes are possible. For mat systems that have corners, the ends of the edging sections would be appropriately angled or otherwise shaped to form the desired corner angle. Internal corners, of any angle, are foreseen. The height of transition portion 60, which generally defines the height of edging section 50 may be the thickness of mat 20, such as for installations where the mats are placed on the same surface as edging sections 50. Alternately, the mats may be partially recessed into a well, or depression, so that edging sections 50 do not need to be the full thickness of the mat. The mat systems that can be created with mats 20, and other embodiments, and edging sections 50, and other embodiments, are countless. Various shapes, sizes, colors, textures, materials, etc. can be used in conjunction to create a mat system. These, and other variations, are within the scope of this invention.

The foregoing disclosure, which includes the description and figures, together with details of the structure and function of the disclosure, is illustrative only, and changes may be made in detail, especially in matters of shape, size and arrangement of parts within the principles of the disclosure to the fill extent indicated by the broad general meaning of the terms in which the appended claims are expressed.

What is claimed is:

1. A floor mat system, comprising:

at least one floor mat having a side edge, the side edge having a first engagement element; and an edging section having a transition portion with a variable thickness and an engagement portion, the engagement portion comprising a side edge and a second engagement element, the second engagement element configured to releaseably engage with the first engagement element;

wherein one of the first and second engagement elements is a hooking element projecting outwardly from the corresponding side edge, and further wherein relative to a line bi-secting the hooking element perpendicular to the corresponding side edge, the hooking element is non-symmetrical;

a second edging section comprising a third engagement element configured to releaseably engage with a fourth engagement element of the floor mat;

wherein the second and third engagement elements are different;

and further wherein the second and third engagement elements are hooking elements.

2. The floor mat system of claim 1, wherein the floor mat has a surface pattern, and the edging section also comprises the surface pattern.

3. The floor mat system of claim 2, wherein the edging section comprises a row of the surface pattern.

4. The floor mat system of claim 1, wherein the first engagement element is a receiver.

5. The floor mat system of claim 1, wherein the transition portion is a ramped portion.

6. The floor mat system of any of claims 1-3, 4 and 5, comprising at least four interlockable floor mats.

7. The floor mat system of claim 1, further comprising at least one corner piece, the corner piece comprising a transition portion and an engagement portion.

8. The floor mat system of claim 1, wherein:

the side edge of the floor mat forms a receptacle;

the second engagement element is a hook projecting from the side edge of the edging section, wherein the hook is nested within the receptacle and the side edge of the floor mat abuts the side edge of the edging section.

9. The floor mat system of claim 8, further comprising a corner piece removably engaged to the edging section, wherein the floor mat has a pattern, and a portion of the edging section and a portion of the corner section also comprise the pattern.

10. The floor mat system of claim 1, wherein;

each of the first and second edging sections define a length between opposing, first and second ends, and a leading edge opposite a trailing edge;

the second engagement element projects from the leading edge of the first edging section;

the third engagement element projects from the leading edge of the second edging section; and relative to direction from the corresponding first end to the corresponding second end, extension of the second engagement element is orthogonal to extension of the third engagement element.

11. A floor mat system comprising:

at least one floor mat having a side edge, the side edge having a first engagement element; and an edging section having a transition portion with a variable thickness and an engagement portion, the engagement portion comprising a side edge and a second engagement element, the second engagement element configured to releaseably engage with the first engagement element;

wherein:

one of the first and second engagement elements is a hooking element projecting outwardly from the corresponding side edge, and further wherein relative to a line bi-secting the hooking element perpendicular to the corresponding side edge, the hooking element is non-symmetrical;

the side edge of the floor mat is a first floor mat side edge and the first engagement element projects from the first floor mat side edge;

the floor mat defines a second floor mat side edge extending orthogonally from the first floor mat side edge such that the first and second floor mat side edges form a point of intersection, the floor mat further including a third engagement element projecting from the second floor mat side edge;

each of the first and second floor mat side edges defines a length in extension from the point of intersection to a corresponding opposing end opposite the point of intersection; and a shape of the first engagement element in a direction from the opposing end of the first floor mat side edge to the point of intersection differs from a shape of the third engagement element in a direction from the point of intersection to the opposing end of the second floor mat side edge.

12. The floor mat system of claim 11, wherein the shape of the first engagement element is orthogonal to the shape of the third engagement element.

13. The floor mat system of claim 11, wherein the floor mat has a surface pattern, and the edging section also comprises the surface pattern.

14. The floor mat system of claim 13, wherein the edging section comprises a row of the surface pattern.

15. The floor mat system of claim 11, wherein the first engagement element is a hooking element and the second engagement element is a receiver.

16. The floor mat system of claim 11, wherein the first engagement element is a receiver and the second engagement element is a hooking element.

17. The floor may system of claim 11, wherein the transition portion is a ramped portion.

18. The floor mat system of claim 11, comprising at least four interlockable floor mats.

19. The floor mat system of claim 11, further comprising at least one corner piece, the corner piece comprising a transition portion and an engagement portion.

* * * * *

UNITED STATES PATENT AND TRADEMARK OFFICE

CERTIFICATE OF CORRECTION

PATENT NO. : 8,298,642 B2
APPLICATION NO. : 12/280571
DATED : October 30, 2012
INVENTOR(S) : Yuan et al.

It is certified that error appears in the above-identified patent and that said Letters Patent is hereby corrected as shown below:

Column 3
Line 43, delete ""books"" and insert -- "hooks" --, therefor.

Column 4
Line 35, delete "SOB." and insert -- 50B. --, therefor.

Line 36, delete "SOB" and insert -- 50B --, therefor.

Line 52, delete "SOB," and insert -- 50B, --, therefor.

Line 64, delete "SOB," and insert -- 50B, --, therefor.

Column 5
Line 2, delete "SOB," and insert -- 50B, --, therefor.

Line 34, delete "3511" and insert -- 35" --, therefor.

Line 67, delete "SOB," and insert -- 50B, --, therefor.

Column 6
Line 6, delete "SOB," and insert -- 50B, --, therefor.

Line 66, delete "fill" and insert -- full --, therefor.

Signed and Sealed this
Nineteenth Day of March, 2013

Teresa Stanek Rea
*Acting Director of the United States Patent and Trademark Office*